US009830883B2

(12) United States Patent
Zhang

(10) Patent No.: US 9,830,883 B2
(45) Date of Patent: Nov. 28, 2017

(54) METHOD AND CIRCUIT FOR ADJUSTING SCREEN BRIGHTNESS AND DISPLAY DEVICE

(71) Applicants: BOE Technology Group Co., Ltd., Beijing (CN); Hefei Xinsheng Optoelectronics Technology Co., Ltd., Anhui (CN)

(72) Inventor: Yanping Zhang, Beijing (CN)

(73) Assignees: BOE TECHNOLOGY GROUP CO., LTD., Beijing (CN); HEFEI XINSHENG OPTOELECTRONICS TECHNOLOGY CO., LTD., Anhui (CN)

( * ) Notice: Subject to any disclaimer, the term of this patent is extended or adjusted under 35 U.S.C. 154(b) by 14 days.

(21) Appl. No.: 14/499,814

(22) Filed: Sep. 29, 2014

(65) Prior Publication Data

US 2015/0325206 A1 Nov. 12, 2015

(30) Foreign Application Priority Data

May 12, 2014 (CN) ..... 2014 1 0199053

(51) Int. Cl.
*G09G 5/00* (2006.01)
*G09G 5/10* (2006.01)

(52) U.S. Cl.
CPC ..... *G09G 5/10* (2013.01); *G09G 2320/0626* (2013.01); *G09G 2330/021* (2013.01); *G09G 2330/028* (2013.01); *G09G 2360/144* (2013.01)

(58) Field of Classification Search
CPC ..... G09G 5/00
See application file for complete search history.

(56) References Cited

U.S. PATENT DOCUMENTS 6,479,940 B1 * 11/2002 Ishizuka ..... G09G 3/3233 315/169.3
2002/0118182 A1 * 8/2002 Luther Weindorf ..... G09G 3/20 345/204

(Continued)

FOREIGN PATENT DOCUMENTS

CN 1652169 A 8/2005
CN 1794044 A 6/2006

(Continued)

OTHER PUBLICATIONS

First Chinese Office Action including Search Report for Chinese Patent Application No. 201410199053.0, dated Sep. 28, 2015, 13 pages.

*Primary Examiner* — Jennifer Mehmood
*Assistant Examiner* — Carl Adams
(74) *Attorney, Agent, or Firm* — Westman, Champlin & Koehler, P.A.

(57) ABSTRACT

The present disclosure provides a method and a circuit for adjusting screen brightness and a display device including the circuit. The method comprises the steps: detecting a light intensity of an environment in which a display screen currently lies; predetermining an optimal brightness value that matches the light intensity of the environment in which the display screen currently lies; comparing the current brightness value of the display screen with the optimal brightness value of the display screen; and if an absolute value of a difference between the current brightness value of the display screen and the optimal brightness value of the display screen is less than or equal to a predetermined threshold value, the process is ended, and if the absolute value of the difference is greater than the predetermined threshold value, the brightness of the display screen is (Continued)

adjusted by adjusting a voltage value of an analog positive power supply of the display screen.

10 Claims, 2 Drawing Sheets

(56) References Cited

U.S. PATENT DOCUMENTS

| | | | | |
|---|---|---|---|---|
| 2002/0158855 | A1* | 10/2002 | Matsueda | G06F 3/03545 345/179 |
| 2003/0063078 | A1* | 4/2003 | Hanari | G09G 3/3233 345/204 |
| 2004/0201562 | A1 | 10/2004 | Funamoto et al. | |
| 2009/0225245 | A1* | 9/2009 | Edwards | G09G 3/3648 349/34 |
| 2012/0019152 | A1 | 1/2012 | Barnhoefer et al. | |

FOREIGN PATENT DOCUMENTS

| | | | |
|---|---|---|---|
| CN | 103021335 | A | 4/2013 |
| CN | 103474047 | A | 12/2013 |
| KR | 10-2012-0008975 | A | 2/2012 |

* cited by examiner

METHOD AND CIRCUIT FOR ADJUSTING SCREEN BRIGHTNESS AND DISPLAY DEVICE

CROSS-REFERENCE TO RELATED APPLICATION

This application claims the benefit of Chinese Patent Application No. 201410199053.0 filed on May 12, 2014 in the State Intellectual Property Office of China, the whole disclosure of which is incorporated herein by reference.

BACKGROUND OF THE INVENTION

Field of the Invention

Embodiments of the present invention relate to the technical field of display, and more particular, to a method and a circuit for adjusting screen brightness and a display device having the circuit.

Description of the Related Art

With the development of mobile communication technique, mobile terminals, such as mobile phones, tablet PCs and the like, are coming in increasing numbers and play more and more important roles in our lives and works. In particular, the mobile terminals have some functions for users' entertainment, such as playing movies, a SMS function, a website browsing function, a QQ chatting function, displaying E-books, supporting video games, a photographic function and the like. These functions provide lots of fun for the users. When the users watch TV or chat on video by using the mobile terminals, the users may neglect gradual changes in light intensity of ambient environment. Such circumstances frequently happen when teenagers play video games. A brighter ambient environment may cause the problem that display contents on a display screen of the mobile terminal cannot be properly seen. In that case, the user usually moves the mobile terminal to be closer to his/her eyes so as to solve the above problem. On the contrary, a darker ambient environment will cause the display contents on the display screen of the mobile terminal to be too glaring for the user's eyes. Such problem is often neglected by the user. Mobile phones, as mobile terminals frequently used by a large number of users, are frequently moved between the brighter ambient environment and the darker ambient environment, for example, from day to night, from the indoors to the outdoors, from the inside of vehicles to the outside of vehicles, from the sunny environment to the darker environment and so on. That the movement between the brighter ambient environment and the darker ambient environment causes the problems of the display contents on the display screen not being properly seen and the screen being too glaring for the user's eyes severely harms the user's vision. Therefore, there is a need to provide a method and a system for adjusting a screen brightness, which can adjust a color brightness value and a contrast value of the display screen by detecting an intensity of an environment light, so that the effect of clearly displaying images and pictures can be achieved.

In the prior art, a CABC function (Content Adaptive Brightness Control) is generally used. With the CABC function, the color brightness value of the display screen is changed by adjusting backlight brightness. However, a timing controller (TCON) is first needed to support such function if the user wants to use it. At the same time, the user has to turn on such function if the user wants to use it. Then, the TCON processes (arithmetic processing) PWM (Pulse Width Modulation) signals, and thus the backlight brightness can be adjusted. In such case, there is needed a higher system cooperation requirement.

SUMMARY OF THE INVENTION

In order to overcome the above mentioned and other technical problems in the prior art, embodiments of the present invention provide a method and a circuit for adjusting screen brightness and a display device having the circuit. With the present disclosure, the problems, that it is difficult to properly see the display contents in the brighter ambient environment and that the screen is too glaring for human eyes in the darker ambient environment, can be overcome or at least mitigated without a higher system cooperation requirement.

According to one aspect of the present invention, there is provided a method for adjusting screen brightness, comprising the steps of:

detecting a light intensity of an environment in which a display screen currently lies;

predetermining an optimal brightness value that matches the light intensity of the environment in which the display screen currently lies, of the display screen, according to human eyes' ability to recognize external images;

comparing the current brightness value of the display screen with the optimal brightness value of the display screen;

if an absolute value of a difference between the current brightness value of the display screen and the optimal brightness value of the display screen is less than or equal to a predetermined threshold value, the process ends; if the absolute value of the difference between the current brightness value of the display screen and the optimal brightness value of the display screen is greater than the predetermined threshold value, the brightness of the display screen is adjusted by adjusting a voltage value of an analog positive power supply (AVDD) of the display screen, so that the absolute value of the difference between the current brightness value of the display screen and the optimal brightness value of the display screen is adjusted to be less than or equal to the predetermined threshold value.

According to another aspect of the present invention, there is provided a circuit for adjusting screen brightness, comprising a light sensing module, a setting module, a comparator, a transmitting module, a DC-DC conversion module and an adjusting module, wherein:

the light sensing module is configured to detect a light intensity of an environment in which a display screen currently lies;

the setting module is configured to predetermine an optimal brightness value that matches the light intensity of the environment in which the display screen currently lies, of the display screen, according to human eyes' ability to recognize external images;

the comparator is configured to compare the current brightness value of the display screen with the optimal brightness value of the display screen;

the transmitting module transmits a comparison information output from the comparator to the DC-DC conversion module when the absolute value of the difference between the current brightness value of the display screen and the optimal brightness value of the display screen is greater than the predetermined threshold value;

the DC-DC conversion module is configured to activate the adjusting module upon receiving the comparison information; and the adjusting module is configured to adjust the brightness of the display screen by adjusting a voltage value of an analog positive power supply of the display screen, so that the absolute value of the difference between the current brightness value of the display screen and the optimal brightness value of the display screen is adjusted to be less than or equal to the predetermined threshold value.

According to a further aspect of the present invention, there is provided a display device including the circuit as described above.

DETAILED DESCRIPTION OF EMBODIMENTS

Figure 1:
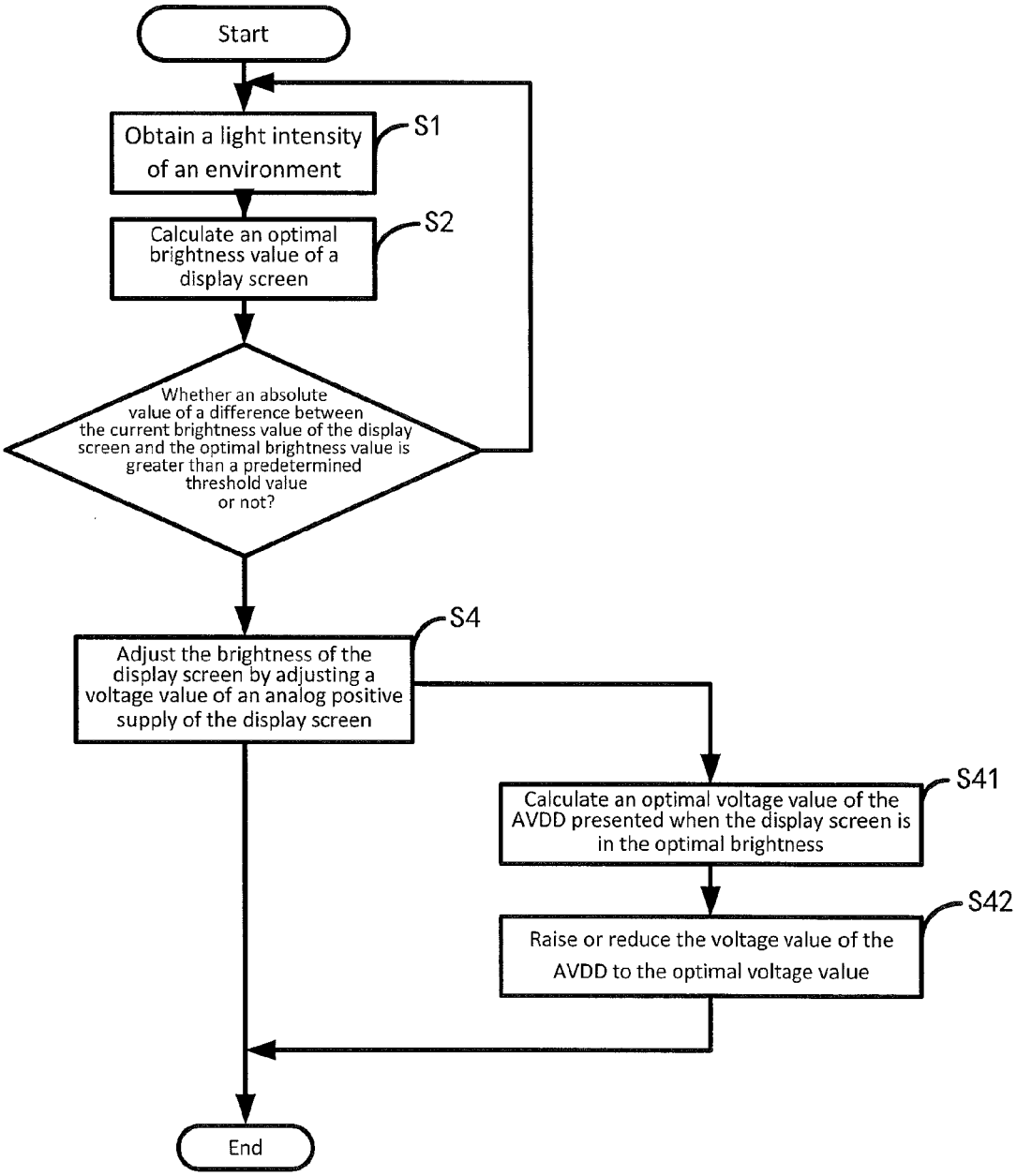
FIG. 1 is a flow chart of a method for adjusting screen brightness in accordance with an embodiment of the present invention.

The objectives, technical schemes and advantages of the present invention will be apparent by describing exemplary embodiments of the present invention hereinafter in detail with reference to the attached drawings, wherein the like reference numerals refer to the like elements.

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically shown in order to simplify the drawing.

As shown in FIG. 1, an embodiment of the present invention provides a method for adjusting screen brightness. The method comprises the following steps.

S1: detecting a light intensity of an environment in which a display screen currently lies. In an embodiment, the light intensity of the environment in which the display screen currently lies is detected by a light intensity sensor. It should be noted that other methods or means may be used for detecting the light intensity of the environment in which the display screen currently lies. No limit is applied to means for detecting the light intensity in the present invention.

S2: predetermining an optimal brightness value that matches the light intensity of the environment in which the display screen currently lies, according to human eyes' ability to recognize external images. In an embodiment of the present invention, the optimal brightness value of the display screen in the current state is calculated based on the light intensity of the environment, a color brightness value and a contrast of the display screen. Such calculation is customarily used in the prior art, and the detailed description of it is omitted herein.

S3: comparing the current brightness value of the display screen with the optimal brightness value of the display screen.

S4: if an absolute value of a difference between the current brightness value of the display screen and the optimal brightness value of the display screen is less than or equal to a predetermined threshold value, the process ends; if the absolute value of the difference between the current brightness value of the display screen and the optimal brightness value of the display screen is greater than the predetermined threshold value, the brightness of the display screen is adjusted by adjusting a voltage value of an analog positive power supply (AVDD) of the display screen, so that the absolute value of the difference between the current brightness value of the display screen and the optimal brightness value of the display screen is adjusted to be less than or equal to the predetermined threshold value.

In an embodiment of the present invention, the step of adjusting the brightness of the display screen by adjusting the voltage value of the analog positive power supply of the display screen further comprises the following steps.

S41: based on the optimal brightness value of the display screen, calculating an optimal voltage value of the analog positive power supply presented when the display screen is in the optimal brightness.

S42: if the current brightness value of the display screen is greater than the optimal brightness value of the display screen, then the voltage value of the analog positive power supply is raised to the optimal voltage value; if the current brightness value of the display screen is lower than the optimal brightness value of the display screen, the voltage value of the analog positive power supply is reduced to the optimal voltage value, so that the brightness of the display screen is adjusted and the effect of clearly displaying images can be achieved.

In principle, the magnitude of the voltage value of the AVDD can influence the brightness of the display screen. Therefore, in the embodiment of the present invention, the voltage value of the AVDD is adjusted based on the comparison between the current brightness value of the display screen and the optimal brightness value of the display screen. In an embodiment, the voltage value of the AVDD can be adjusted by an on-line programmable DC-DC conversion module.

It can be appreciated from the foregoing description that the voltage value of the analog positive power supply (AVDD) of the display screen is changed by detecting the light intensity of the environment in the embodiment of the present invention. The color brightness value and the contrast value of the display screen can be adjusted to achieve the effect of clearly displaying images, without being adapted to external systems. Furthermore, the voltage value of the analog positive power supply of the display screen can be changed independently. Such changes cause little influence on power consumption.

Figure 2:
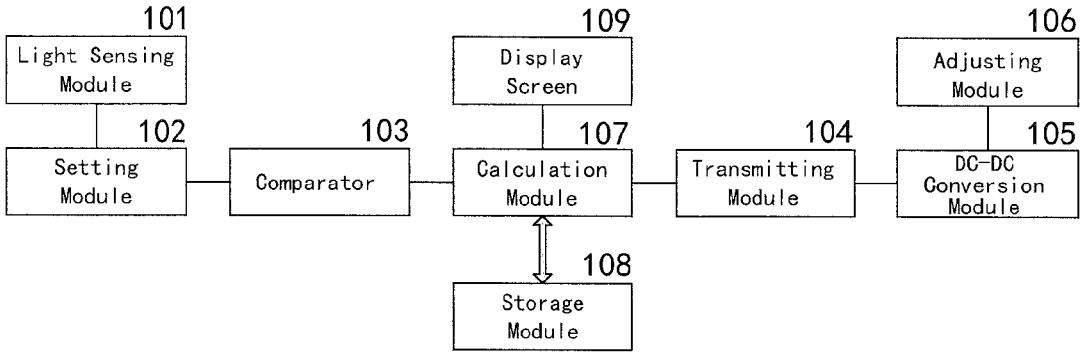
FIG. 2 is a structural schematic view of a circuit for adjusting screen brightness in accordance with an embodiment of the present invention.

The embodiments of the present invention also provide a circuit for adjusting screen brightness. As shown in FIG. 2, the circuit comprises a light sensing module 101, a setting module 102, a comparator 103, a transmitting module 104, a DC-DC conversion module 105 and an adjusting module 106. The light sensing module 101 is configured to detect a light intensity of an environment in which a display screen currently lies. In an embodiment, the light intensity of the environment in which the display screen currently lies is detected by a light intensity sensor. It should be noted that other light sensing devices or means may be used for detecting the light intensity of the environment in which the display screen currently lies. No limit is applied to means for detecting the light intensity in the present invention.

The setting module 102 is configured to predetermine an optimal brightness value that matches the light intensity of the environment in which the display screen currently lies, according to human eyes' ability to recognize external images. The comparator 103 is configured to compare the current brightness value of the display screen with the optimal brightness value of the display screen. If an absolute value of a difference between the current brightness value of the display screen and the optimal brightness value of the display screen is less than or equal to a predetermined threshold value, the light sensing module 101 is instructed to continue detecting the light intensity of the environment in which the display screen currently lies.

When the absolute value of the difference between the current brightness value of the display screen and the optimal brightness value of the display screen is greater than the predetermined threshold value, the transmitting module 104 transmits the comparison information (for example, the absolute value of the difference between the current brightness value of the display screen and the optimal brightness value of the display screen) from the comparator 103 to the DC-DC conversion module 105.

The DC-DC conversion module 105 is configured to activate the adjusting module 106 upon receiving the comparison information.

The adjusting module 106 is configured to adjust the brightness of the display screen by adjusting a voltage value of an analog positive power supply (AVDD) of the display screen, so that the absolute value of the difference between the current brightness value of the display screen and the optimal brightness value of the display screen is adjusted to be less than or equal to the predetermined threshold value.

The circuit further comprises a calculation module 107 configured to calculate an optimal voltage value of the analog positive power supply presented when the display screen is in the optimal brightness, based on the optimal brightness value of the display screen. The adjusting module 106 is configured to raise the voltage value of the analog positive power supply to the optimal voltage value when the current brightness value of the display screen is greater than the optimal brightness value of the display screen, and to reduce the voltage value of the analog positive power supply to the optimal voltage value when the current brightness value of the display screen is lower than the optimal brightness value of the display screen, so that the brightness of the display screen is adjusted.

Figure 3:
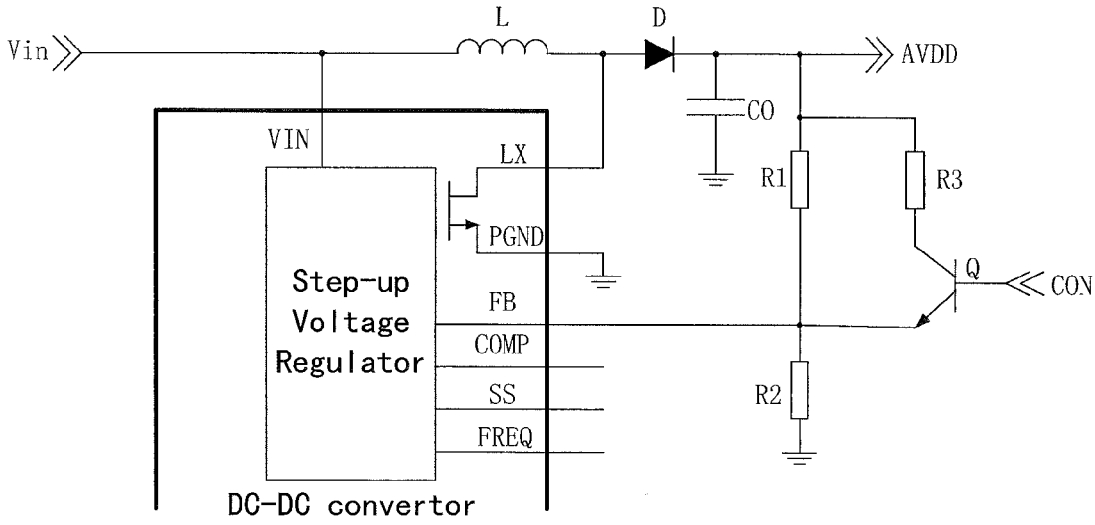
FIG. 3 is a schematic view of a circuit for an AVDD in accordance with an embodiment of the present invention, in which a voltage value of the AVDD can be adjusted to be raised or reduced by adjusting a resistance of a resistor R3.

FIG. 3 is a schematic view of a circuit for an AVDD in accordance with an embodiment of the present invention, in which the voltage value of the AVDD can be adjusted to be raised or reduced by adjusting a resistance of a resistor R3. For example, the voltage value of the AVDD can be reduced as the resistance of the resistor R3 is reduced, and the voltage value of the AVDD can be raised as the resistance of the resistor R3 is raised.

In an embodiment of the present invention, the DC-DC conversion module 105 may be an on-line programmable module. The voltage value of the AVDD can be adjusted at real-time by the DC-DC conversion module.

In an embodiment of the present invention, the circuit further comprises a storage module 108 connected with the calculation module 107 and configured to store data created during calculation.

In an embodiment of the present invention, the circuit further comprises a display module 109 connected with the calculation module 107 and configured to display data created during calculation.

Further, the embodiments of the present invention provide a display device (not shown) including the circuit for adjusting the screen brightness as described above.

With the above-described solutions of the embodiment of the present invention, the brightness of the display screen can be changed by changing the voltage value of the AVDD, so that the problems, that it is difficult to properly see the display contents in the brighter ambient environment and that the screen is too glaring for human eyes in the darker ambient environment, can be overcome or at least mitigated, thereby achieving the effect of clearly displaying images in spite of ambient environment the display screen lies in.

It should be noted that the above described embodiments are exemplary embodiments of the present invention only and are not intended to limit the present invention. It would be appreciated by those skilled in the art that various changes and substitutions may be made without departing from the principle and spirit of the disclosure. Such changes and substitutions fall within the scope of the disclosure.

What is claimed is:

1. A method for adjusting screen brightness, comprising the steps of:

detecting a light intensity of an environment in which a display screen currently lies;

predetermining an optimal brightness value that matches the light intensity of the environment in which the display screen currently lies, of the display screen, according to human eyes' ability to recognize external images;

comparing the current brightness value of the display screen with the optimal brightness value of the display screen;

if an absolute value of a difference between the current brightness value of the display screen and the optimal brightness value of the display screen is less than or equal to a predetermined threshold value, the process ends; if the absolute value of the difference between the current brightness value of the display screen and the optimal brightness value of the display screen is greater than the predetermined threshold value, the brightness of the display screen is adjusted by adjusting a voltage value of an analog positive power supply of the display screen by means of an adjusting module, so that the absolute value of the difference between the current brightness value of the display screen and the optimal brightness value of the display screen is adjusted to be less than or equal to the predetermined threshold value;

wherein the step of adjusting the brightness of the display screen by adjusting the voltage value of the analog positive power supply of the display screen by means of an adjusting module further comprises the steps of:

based on the optimal brightness value of the display screen, calculating an optimal voltage value of the analog positive power supply presented when the display screen is in the optimal brightness;

if the current brightness value of the display screen is greater than the optimal brightness value of the display screen, then the voltage value of the analog positive power supply is raised to the optimal voltage value means by means of the adjusting module; if the current brightness value of the display screen is lower than the optimal brightness value of the display screen, the voltage value of the analog positive power supply is reduced to the optimal voltage value by means of the adjusting module, so that the brightness of the display screen is adjusted.

2. The method according to claim 1, wherein the voltage value of the analog positive power supply is adjusted by an on-line programmable DC-DC conversion module.

3. A circuit for adjusting screen brightness, comprising a light sensing module, a setting module, a comparator, a transmitting module, a DC-DC conversion module, an adjusting module and a calculation module, wherein:

the light sensing module is configured to detect a light intensity of an environment in which a display screen currently lies;

the setting module is configured to predetermine an optimal brightness value that matches the light intensity of the environment in which the display screen currently lies, of the display screen, according to human eyes' ability to recognize external images;

the comparator is configured to compare the current brightness value of the display screen with the optimal brightness value of the display screen;

the transmitting module transmits a comparison information output from the comparator to the DC-DC conversion module when the absolute value of the difference between the current brightness value of the display screen and the optimal brightness value of the display screen is greater than the predetermined threshold value;

the DC-DC conversion module is configured to activate the adjusting module upon receiving the comparison information; and the adjusting module is configured to adjust the brightness of the display screen by adjusting a voltage value of an analog positive power supply of the display screen, so that the absolute value of the difference between the current brightness value of the display screen and the optimal brightness value of the display screen is less than or equal to the predetermined threshold value;

wherein the calculation module is configured to calculate an optimal voltage value of the analog positive power supply presented when the display screen is in the optimal brightness, based on the optimal brightness value of the display screen;

wherein the adjusting module is configured to raise the voltage value of the analog positive power supply to the optimal voltage value when the current brightness value of the display screen is greater than the optimal brightness value of the display screen, and to reduce the voltage value of the analog positive power supply to the optimal voltage value when the current brightness value of the display screen is lower than the optimal brightness value of the display screen, so that the brightness of the display screen is adjusted.

4. The circuit according to claim 3, wherein the DC-DC conversion module is an on-line programmable module.

5. The circuit according to claim 3, further comprising a storage module connected with the calculation module and configured to store data created during calculation.

6. The circuit according to claim 3, further comprising a display module connected with the calculation module and configured to display data created during calculation.

7. A display device, including the circuit according to claim 3.

8. The display device according to claim 7, wherein the DC-DC conversion module of the circuit is an on-line programmable module.

9. The display device according to claim 7, wherein the circuit further comprises a storage module connected with the calculation module and configured to store data created during calculation.

10. The display device according to claim 7, wherein the circuit further comprises a display module connected with the calculation module and configured to display data created during calculation.

* * * * *